US006071115A

United States Patent [19]

Carbone et al.

[11] Patent Number: 6,071,115

[45] **Date of Patent: *Jun. 6, 2000**

[54] APPARATUS FOR LOW $NO_x$, RAPID MIX COMBUSTION

[75] Inventors: Philip C. Carbone, North Reading; Karen R. Benedek; Stephan E. Schmidt, both of Winchester, all of Mass.; Charles E. Benson, Windham, N.H.

[73] Assignee: Gas Research Institute, Chicago, Ill.

[ * ] Notice: This patent is subject to a terminal disclaimer.

[21] Appl. No.: 08/925,814

[22] Filed: Sep. 5, 1997

Related U.S. Application Data

[63] Continuation-in-part of application No. 08/625,926, Apr. 1, 1996, Pat. No. 5,681,159, which is a continuation of application No. 08/212,177, Mar. 11, 1994, abandoned.

[51] Int. Cl.[7] ..... F23M 3/00

[52] U.S. Cl. ..... 431/350; 431/8; 431/9; 431/354; 431/115; 431/10

[58] Field of Search ..... 431/190, 353, 431/350, 351, 9, 354, 115, 159, 116, 164, 165, 166, 167, 10, 8; 60/732, 737

[56] References Cited

U.S. PATENT DOCUMENTS

| | | | |
|---|---|---|---|
| 399,864 | 3/1889 | Fisk . | |
| 878,590 | 2/1908 | York et al. | 431/188 |
| 1,163,650 | 12/1915 | Fogler | 431/351 |
| 1,304,402 | 5/1919 | Spire | 431/188 |
| 2,333,531 | 11/1943 | Ferguson . | |
| 2,582,577 | 1/1952 | Zink et al. . | |
| 2,932,349 | 4/1960 | Ferguson . | |
| 3,063,494 | 11/1962 | Meyer | 431/351 |
| 3,782,887 | 1/1974 | Brown . | |
| 3,820,320 | 6/1974 | Schirmer et al. . | |
| 3,826,077 | 7/1974 | Quigg et al. . | |
| 3,826,079 | 7/1974 | Quigg et al. . | |
| 3,828,762 | 8/1974 | Duzey . | |
| 4,004,875 | 1/1977 | Zink et al. . | |

(List continued on next page.)

FOREIGN PATENT DOCUMENTS

| | | | |
|---|---|---|---|
| 920051 | 1/1973 | Canada . | |
| 0052191 | 5/1982 | European Pat. Off. | 431/350 |
| 53-126527 | 4/1978 | Japan . | |
| 53-111531 | 9/1978 | Japan . | |
| 0102822 | 8/1980 | Japan . | |
| 57-31711 | 2/1982 | Japan . | |
| 57-60107 | 4/1982 | Japan . | |
| 0155006 | 9/1982 | Japan . | |
| 406174207 | 6/1994 | Japan . | |
| 930589 | 7/1963 | United Kingdom . | |
| 2048456 | 12/1980 | United Kingdom . | |

*Primary Examiner*—Carl D. Price
*Attorney, Agent, or Firm*—Pauley Petersen Kinne & Fejer

[57] ABSTRACT

A process and apparatus for combusting fuel which results in reduction of nitrogen oxides and carbon monoxides emissions. Fuel and primary air are preferably premixed and introduced into a combustion chamber. Secondary air is introduced through a plurality of secondary air ports, each preferably shaped as a slot, which are positioned about a venturi nozzle or flame holder disk mounted with respect to a combustion chamber wall. The secondary air flowing through the secondary air ports forms relatively high velocity and momentum secondary air jets that promote rapid mixing of the fuel and primary air mixture into the secondary air flow, such that a combustion flame is established at a partial periphery of the secondary air jets.

8 Claims, 8 Drawing Sheets

U.S. PATENT DOCUMENTS

| | | | |
|---|---|---|---|
| 4,181,491 | 1/1980 | Hovis . | |
| 4,331,638 | 5/1982 | Michelfelder . | |
| 4,348,168 | 9/1982 | Coulon . | |
| 4,357,134 | 11/1982 | Katsushige et al. . | |
| 4,457,704 | 7/1984 | Sommers et al. . | |
| 4,511,325 | 4/1985 | Voorheis . | |
| 4,531,904 | 7/1985 | Sato et al. . | |
| 4,610,625 | 9/1986 | Bunn . | |
| 4,629,413 | 12/1986 | Michelson et al. . | |
| 4,702,691 | 10/1987 | Ogden . | |
| 4,776,320 | 10/1988 | Ripka et al. . | |
| 4,784,600 | 11/1988 | Moreno . | |
| 5,104,310 | 4/1992 | Saltin | 431/350 |
| 5,123,401 | 6/1992 | Lange | 431/167 |
| 5,244,381 | 9/1993 | Cahlik . | |
| 5,370,529 | 12/1994 | Lu et al. . | |
| 5,441,405 | 8/1995 | Bedford et al. . | |
| 5,681,159 | 10/1997 | Benedek et al. | 431/9 |

APPARATUS FOR LOW $NO_X$, RAPID MIX COMBUSTION

CROSS REFERENCE TO RELATED APPLICATIONS

This is a continuation-in-part patent application of patent application having Ser. No. 08/625,926, filed Apr. 1, 1996, now U.S. Pat. No. 5,681,159, which issued Oct. 28, 1997 which is a continuation of patent application having Ser. No. 08/212,177, filed Mar. 11, 1994, now abandoned.

BACKGROUND OF THE INVENTION

1. Field of the Invention

This invention relates to a process and apparatus for reducing the emission of nitrogen oxides and carbon monoxide, particularly in furnaces or heaters fired with natural gas, wherein secondary air is introduced into a combustion chamber by forming a plurality of relatively high velocity secondary air jets that promote rapid mixing of a fuel and primary air mixture into the secondary air flow.

2. Description of Prior Art

U.S. Pat. No. 4,511,325 discloses a burner for reducing nitrogen oxides ($NO_x$) emissions. Make-up air is introduced through delivery ports which are laterally spaced from a fuel injection nozzle and a main air opening. The make-up air is introduced through the air delivery ports at a sufficient pressure so that the air penetrates deep into the combustion chamber.

U.S. Pat. No. 4,601,625 teaches a gas burner having axially directed jet members positioned in an opening within a firewall. Fuel and air are premixed and then injected into a combustion chamber through tubular jets that extend into the combustion chamber. Secondary combustion air is introduced into the combustion chamber through secondary air jets that each have a discharge end directed at an angle to create swirling secondary air flow within the combustion chamber.

U.S. Pat. No. 4,629,413 discloses a burner which uses secondary air to reduce $NO_x$ emissions. Secondary air ports are positioned about the nozzle and are used to introduce secondary air into the combustion chamber.

U.S. Pat. No. 4,531,904 teaches fuel gas nozzles which inject fuel into combustion air flowing through an annular passage.

The combustion of fossil fuels results in the emission of pollutants to the environment, including oxides of nitrogen (NO and $NO_2$) and carbon monoxide (CO). The exhaust gases of natural-gas-fired furnaces and heaters for residential or commercial applications typically contain $NO_x$ concentrations of 60–120 parts per million (dry, corrected to 3% $O_2$) and CO concentrations of 5–20 ppm (dry, at 0% $O_2$). It is desirable to reduce $NO_x$ emissions from furnaces and heaters at standard operating conditions without significantly increasing CO emissions.

The firing density of furnace heat exchangers can be limited by the point at which the CO emissions increase beyond acceptable levels. This is called the "sour point" of the furnace. For safety purposes, it is desirable to have a sour point at a firing density well above the operating point of the furnace. Alternatively, a combustion system that allows the sour point to be moved to higher firing rates, and therefore extend the operating range of the furnace, is desirable.

SUMMARY OF THE INVENTION

It is one object of this invention to provide a process and apparatus for reducing $NO_x$ emissions and CO emissions by creating high-velocity secondary air jets by introducing secondary air through holes or slots and into a combustion chamber. The high-velocity secondary air jets promote rapid mixing of the fuel and primary air mixture into the secondary air flow.

It is another object of this invention to provide a process and apparatus wherein the secondary air jets draw a combustion flame outward toward a portion of a periphery of an envelope formed by each secondary air jet and anchor the combustion flame about each such periphery.

The above and other objects of this invention are accomplished with a process of combustion wherein fuel and primary air are preferably premixed within a venturi nozzle and injected into a combustion chamber. The fuel and primary air mixture preferably but not necessarily passes through a flame holder disk which is used to locate and control the velocity of the fuel and primary air mixture within the combustion chamber. Secondary air is introduced through a plurality of secondary air ports, such as holes or slots, positioned within a combustion chamber wall or another suitable structure fixed with respect to the combustion chamber wall, and positioned about or around the flame holder disk or other suitable inlet. Secondary air is introduced through such secondary air ports so that a plurality of high-velocity secondary air jets are created for promoting rapid mixing of the fuel and primary air mixture into the secondary air flow, so that the combustion flame is anchored at a portion of the periphery of the secondary air jets.

As the secondary air passes through the secondary air ports, the secondary air flow entrains combustion products within the combustion chamber in an upstream direction, with respect to a downstream direction that the combustion products flow through, and discharge from, the combustion chamber. In one preferred embodiment according to this invention, the entrained combustion products effectively suppress an operating temperature of a combustion flame, particularly at an anchored position of the combustion flame, near a portion of the periphery of each of the secondary air jets.

The secondary air jets have a relatively high momentum, with respect to the momentum of the fuel and primary air. In one preferred embodiment according to this invention, the momentum of the fuel and primary air mixture is approximately 30%–40% of the momentum of each secondary air jet. However, the fuel and primary air mixture preferably flows at least at a rate which is sufficient to prevent flashback of the fuel and primary air mixture.

The secondary air ports and the secondary air flow through the ports are preferably but not necessarily designed to prevent the combustion flame from anchoring at or attaching to an edge of a suitable structure defining the secondary air ports.

In one preferred embodiment according to this invention, the fuel and primary air mixture is fuel-enriched beyond a rich flammability limit of the fuel. For example, with natural gas, the fuel and primary air mixture can have an equivalence ratio of fuel to primary air in a range of approximately 1.7–2.5. A burner according to this invention can also operate with a fuel and primary air equivalence ratio as low as about 1.4.

In one preferred embodiment of this invention, the secondary air flows through secondary air ports that each have a swaged inlet section, in order to achieve the relatively high velocity of the secondary air jets at an acceptable pressure drop. The swaged configuration of the secondary air port is one way to create a high-velocity, narrow angle, secondary air jet that is quite helpful for rapidly mixing the fuel and primary air mixture with the secondary air and thereby reducing the undesirable emissions and establishing a stable flame.

BRIEF DESCRIPTION OF DRAWINGS

The above-mentioned and other features and objects of this invention will be better understood from the following detailed description read in view of the drawings wherein.

DESCRIPTION OF PREFERRED EMBODIMENTS

Figure 1A:
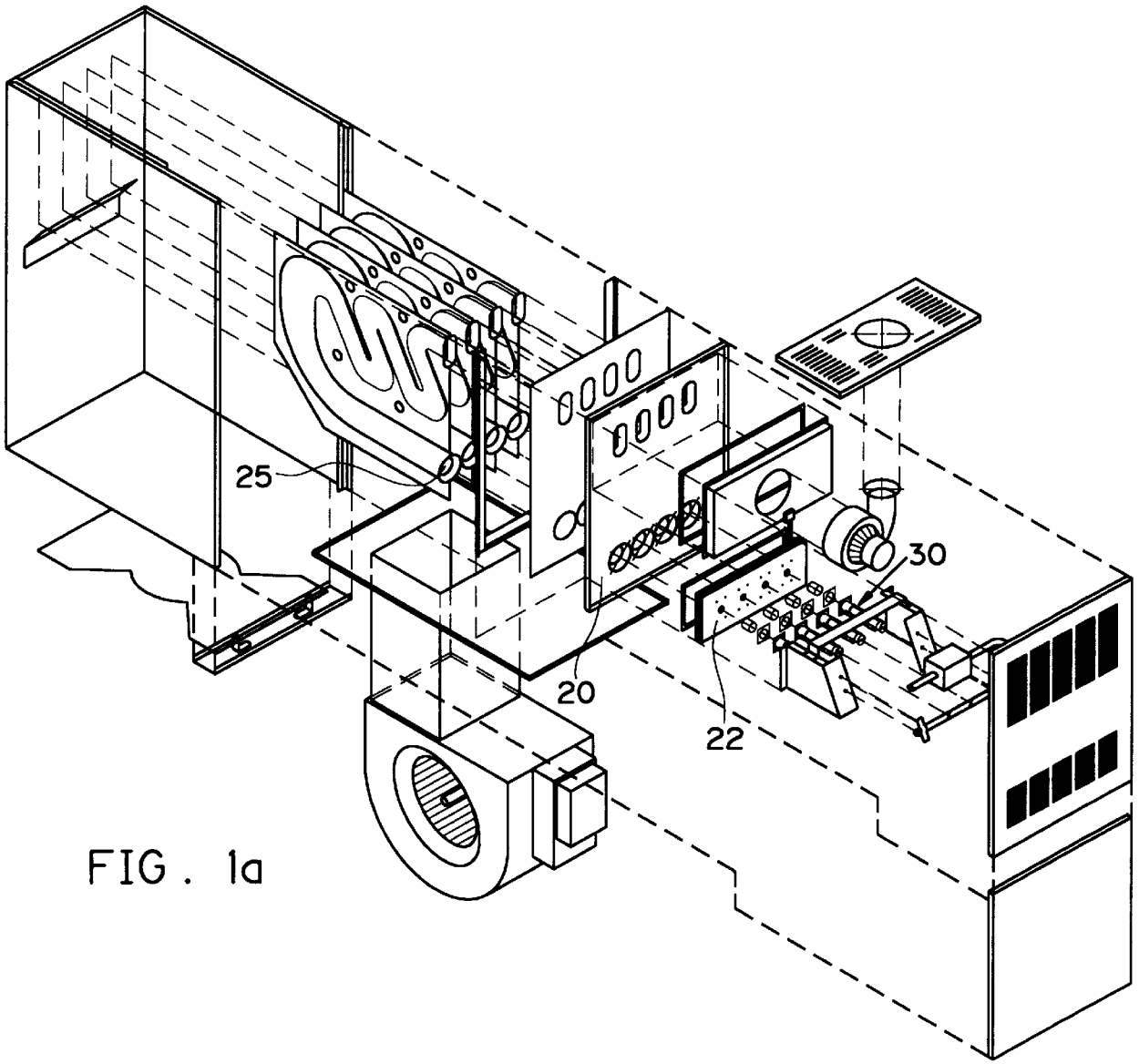
FIG. 1A is an exploded perspective view of a furnace showing four burners, each having a venturi nozzle, according to one preferred embodiment of this invention.
Figure 1B:
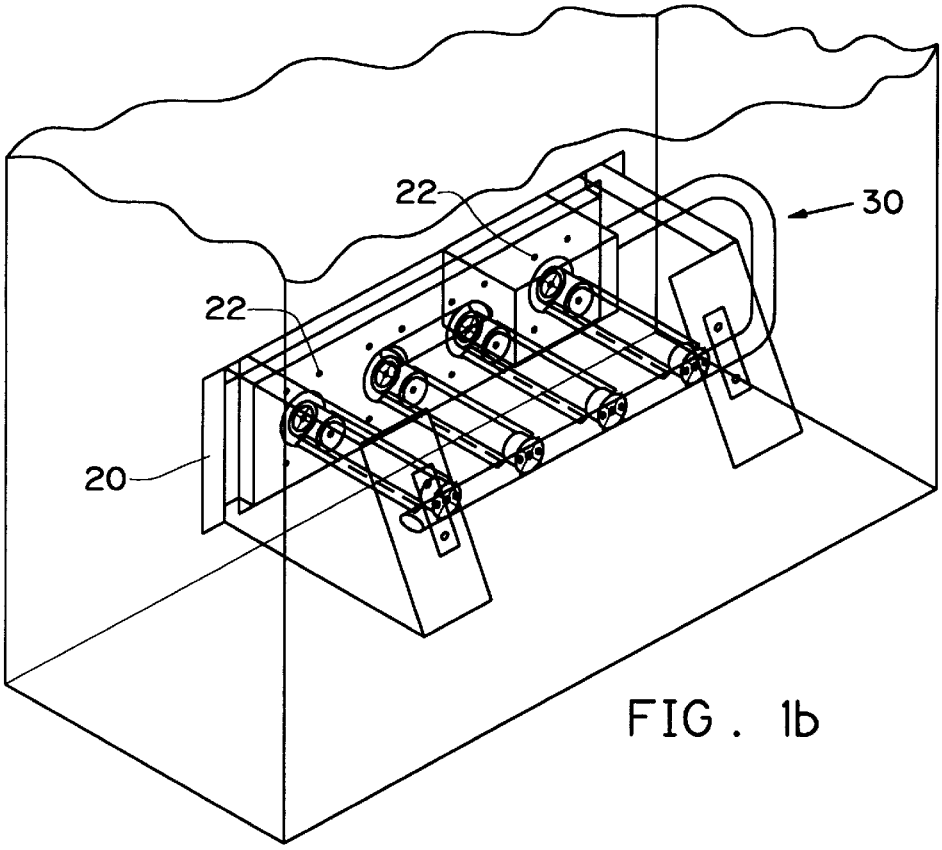
FIG. 1B is a schematic perspective view of the four burners and a manifold mounted with respect to a wall of a furnace.
Figure 2:
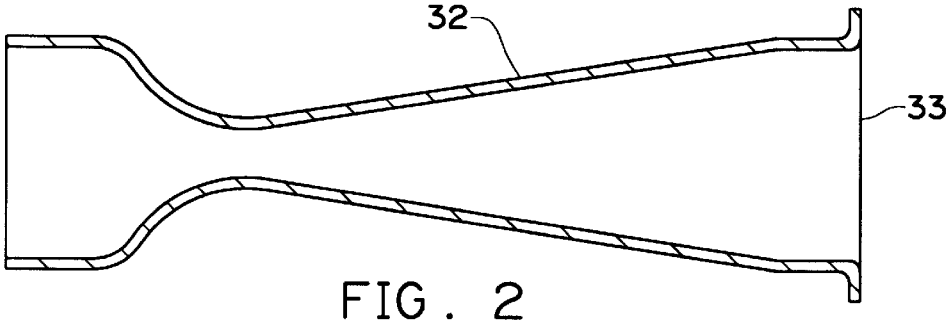
FIG. 2 is a cross-sectional view of a venturi nozzle, according to one preferred embodiment of this invention.
Figure 5:
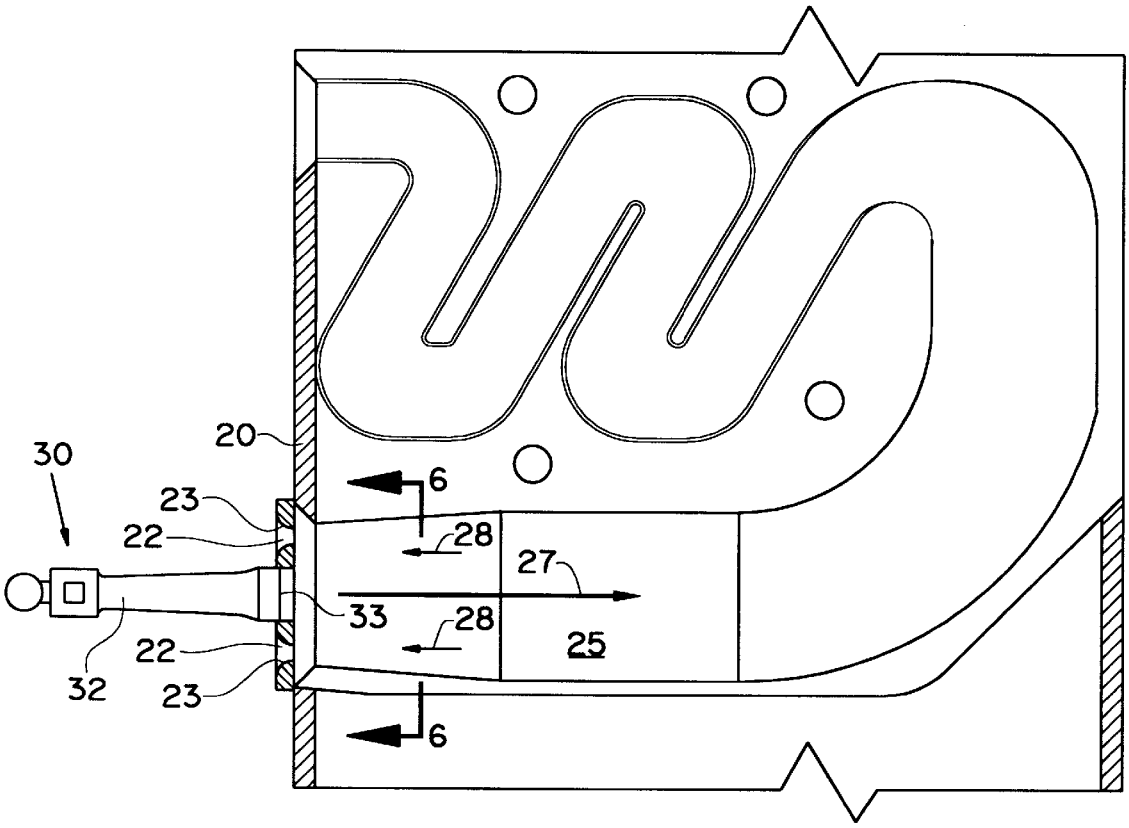
FIG. 5 is a cross-sectional diagrammatic view of a venturi nozzle and a flame holder disk mounted with respect to a furnace wall, according to one preferred embodiment of this invention.
Figure 4A:
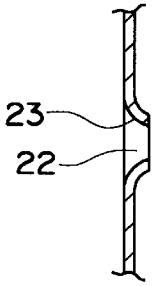
FIG. 4A is a partial cross-sectional view of a wall or other similar structural member having a swaged secondary air port formed as a hole, according to one preferred embodiment of this invention.
Figure 4B:
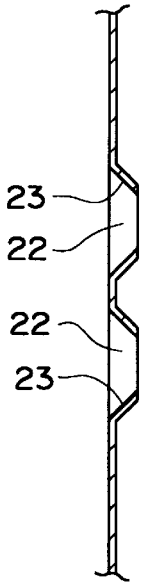
FIG. 4B is a partial cross-sectional view of a wall or other similar structural member having a swaged secondary air port formed as a slot, according to another preferred embodiment of this invention.

FIG. 1A shows an exploded perspective view of a furnace having four independent combustion chambers 25, each associated with one venturi nozzle 32, for example as shown in FIGS. 2 and 5. FIG. 5 is a cross-sectional diagrammatic view of one combustion chamber 25, as shown in FIG. 1. FIG. 4A is a partial cross-sectional view showing combustion chamber wall 20 or another suitable wall or structural element having swaged secondary air port 23 formed as a hole, according to one preferred embodiment of this invention. It is apparent that the hole can have any suitable shape, such as round, polygonal, crescent or the like, that forms a suitably shaped secondary air jet 45. FIG. 4B is a partial cross-sectional view of combustion chamber wall 20 having swaged secondary air port 23 formed as a slot, according to another preferred embodiment of this invention. It is apparent that the slot can have any suitable shape, such as an arcuate or a crescent shape as shown in FIG. 6B, that forms a suitably shaped secondary air jet 45.

In a preferred process of combustion, according to one embodiment of this invention, fuel and primary air are introduced into combustion chamber 25. Preferably, the fuel and primary air are premixed within venturi nozzle 32, before being introduced into combustion chamber 25. The fuel and primary air mixture preferably but not necessarily passes through flame holder disk 52 and is then introduced into combustion chamber 25. However, it is apparent that other suitable means can be used to introduce the fuel and primary air mixture into combustion chamber 25.

Figure 6A:
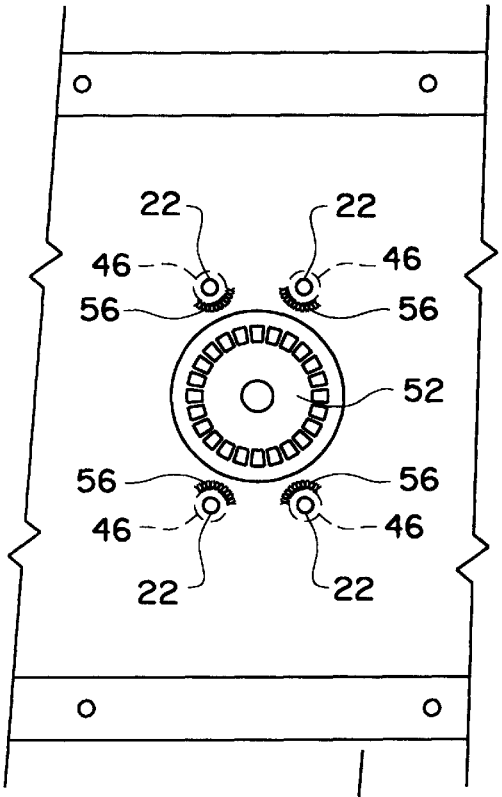
FIG. 6A is a view of a discharge end of a flame holder disk mounted with respect to a combustion chamber wall and four holes as secondary air ports, taken along line 6—6 as shown in FIG. 5, according to one preferred embodiment of this invention.
Figure 6B:
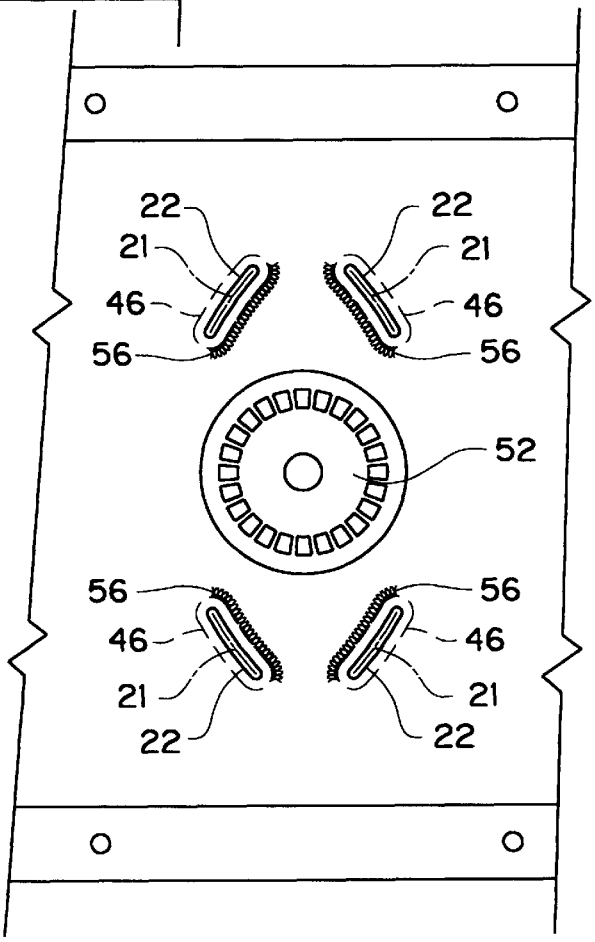
FIG. 6B is a view of a discharge end of a flame holder disk mounted with respect to a combustion chamber wall and four arcuate slots as secondary air ports, taken along line 6—6 as shown in FIG. 5, according to another preferred embodiment of this invention.

In one preferred embodiment according to this invention, secondary air is introduced through a plurality of secondary air ports 22 which are positioned about flame holder disk 52, for example as shown in FIG. 6 or FIG. 6B. Secondary air ports 22 are preferably formed into a sheet metal wall, for example combustion chamber wall 20. However, it is apparent that the secondary air can be introduced through other secondary air ports 22 which are formed within a plate or other suitable structural member, particularly those known to persons skilled in the art of furnace design, secured either directly to or with respect to combustion chamber wall 20, or can even be introduced through secondary air inlet tubes which are known to persons skilled in the art of furnace design.

Figure 8:
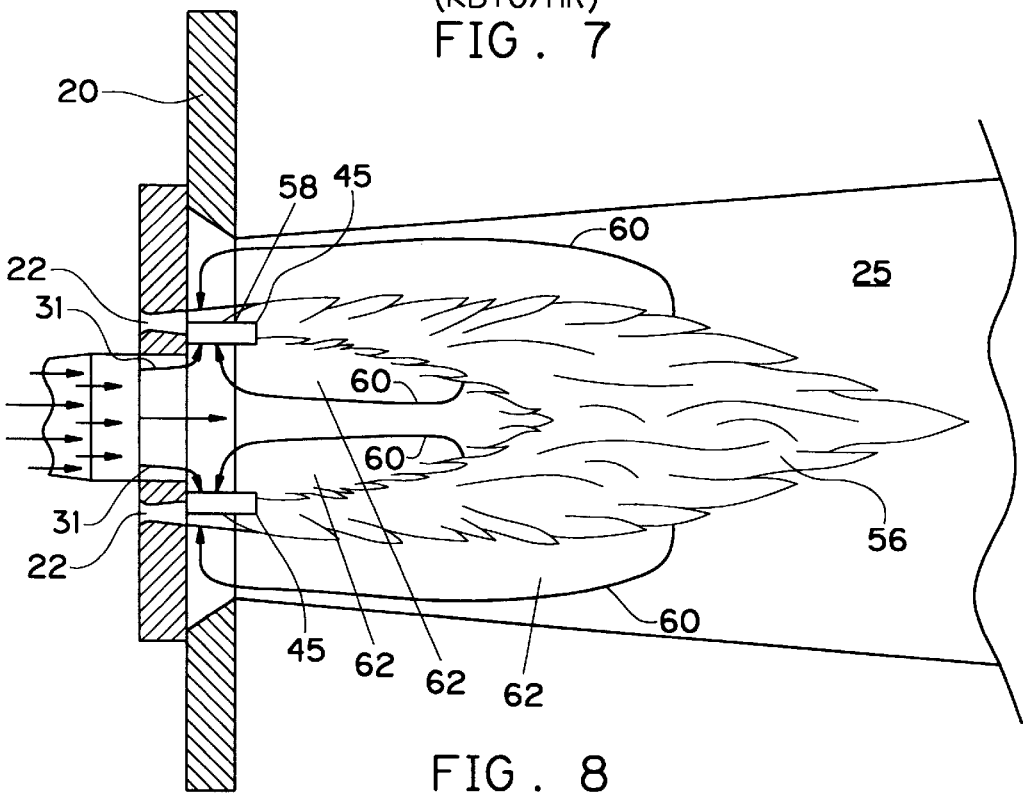
FIG. 8 is a diagrammatic view showing a general shape of a combustion flame and a region of flame stabilization, according to one preferred embodiment of this invention.

As the secondary air passes through secondary air port 22 or secondary air inlet tubes 23, a plurality of relatively high velocity and high momentum secondary air jets 45 are formed, as shown in FIG. 8. Such secondary air jets 45 promote rapid mixing of the fuel and primary air mixture into the secondary air flow, which cause combustion flame 56 to become established or anchored at a portion of a periphery of secondary air jets 45. The shaded areas of FIGS. 6A and 6B show the general boundaries of combustion flame 56 that anchors about a partial periphery of each secondary air jet 45. The boundaries of secondary air jet 45 are generally shown by dashed lines 46. The boundaries shown in FIGS. 6A and 6B are generally taken at a plane defined by line 6—6, as shown in FIG. 5.

FIG. 8 shows a diagrammatic view of combustion flame 56 and the associated flame stabilization region 58 established near secondary air jets 45. The particular shape of combustion flame 56 depends upon the shape, size and position of secondary air ports 22. FIG. 6A shows diagrammatically the cross-sectional configuration of combustion flame 56, with circular holes forming secondary air ports 22. FIG. 6B shown diagrammatically the cross-sectional configuration of combustion flame 56, with slots forming secondary air ports 22.

As used throughout this specification and in the claims, the terms air and oxidant are intended to be interchangeable. It is apparent that the process of combustion according to this invention can operate with air, oxygen-enriched air, oxygen or any other suitable oxidant. The term fuel as used throughout this specification and in the claims relates to any suitable gaseous fuel, atomized fuel, gasified or any other suitable type of fuel. Natural gas and other gaseous fuel are preferred but not necessary for operation with the low $NO_x$ combustion apparatus and process according to this invention.

The relatively high velocity and momentum of secondary air jets 45 tends to entrain combustion products from downstream of combustion flame 56, in upstream direction 28 within combustion chamber 25, as shown in FIG. 5. In one preferred embodiment according to this invention, the momentum of primary flow of the fuel and primary air mixture is approximately 30% to approximately 40% of the momentum of secondary flow of each secondary air jet 45. Also, the fuel and primary air preferably flow at a minimum rate or with a minimum flow momentum which is sufficient to prevent flashback of the fuel and primary air mixture and to maintain flame stability.

The high velocity of secondary air jets 45 entrain the combustion products in a manner that suppresses the operating temperature of combustion flame 56, particularly where combustion flame 56 is anchored about a periphery of each of secondary air jets 45. The entrained combustion products are generally directed towards secondary air jets 45, as indicated by arrows 60 in FIG. 8. Each secondary air jet 45 is preferably sized to prevent combustion flame 56 from anchoring at combustion chamber wall 20, or at any other suitable structure, about secondary air ports 22.

In one preferred embodiment according to this invention, the fuel and primary air mixture is fuel-enriched beyond a rich flammability limit of the fuel. Thus, in such preferred embodiment, the fuel and primary air mixture is so rich that the fuel and primary air mixture cannot burn under the fuel and primary air conditions within a particular region or zone of combustion chamber 25. Secondary air jets 45 draw or entrain the fuel and primary air mixture toward a periphery of, or envelope established by, secondary air jets 45, as indicated by arrows 31 in FIG. 8, so that the fuel can combust in a fashion that forms or establishes combustion flame 56 about at least a portion of a periphery of each secondary air jet 45. In the case of a natural gas burner, the fuel and primary air mixture preferably has an equivalence ratio of fuel to primary air in a range of approximately 1.7 to approximately 2.5.

Experiments conducted according to the process and apparatus of this invention prove that passing the secondary air through swaged inlet 23 of secondary air port 22, as shown in FIGS. 4A and 4B, results in significantly improved combustion results, such as greatly improved flame stability and higher levels of excess air. As used throughout this specification and in the claims, the word swaged is intended to relate to the surface of the structure, that forms secondary air port 22, curving in a converging manner, converging with respect to a downstream flow direction, such as shown in FIGS. 4A and 4B.

Figure 3A:
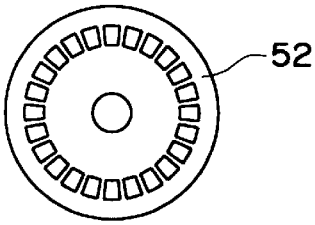
FIG. 3A is a front view of a flame holder disk, according to one preferred embodiment of this invention.
Figure 3B:
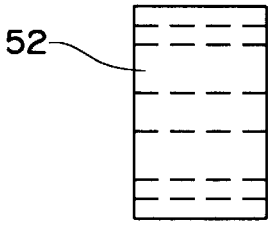
FIG. 3B is a side view of the flame holder disk shown in FIG. 3A.

The apparatus of this invention preferably comprises at least one combustion chamber wall 20 which forms combustion chamber 25, as shown in FIG. 5. Combustion chamber 25 is preferably but not necessarily sealed with respect to the surrounding environment, except for any infiltration that may occur. Flame holder disk 52, as shown in FIGS. 3A and 3B, is preferably but not necessarily mounted within discharge end 33 of venturi nozzle 32. Flame holder disk 52 can be mounted with respect to combustion chamber wall 20 in any other suitable manner known to those skilled in the art of furnace design. When venturi nozzle 32 is mounted with respect to combustion chamber wall 20, for example as shown in FIG. 1B, the fuel and primary air pass through primary air ports within flame holder disk 52. Discharge end 33 of venturi nozzle 32 is preferably but not necessarily sealed and secured with respect to combustion chamber wall 20.

Primary means 30 are used to form the fuel and primary air mixture, and to introduce the fuel and primary air mixture into combustion chamber 25. In one preferred embodiment according to this invention, such primary means comprise venturi nozzle 32 and/or flame holder disk 52. It is apparent that venturi nozzle 32 and flame holder disk 52 can be designed in various manners to produce different sizes, shapes and types of fuel and primary air flow and thus different types of flames. Primary means 30 may also comprise a pressurized fuel supply and/or a pressurized air supply in communication with combustion chamber 25.

Secondary air inlet means are used to introduce the secondary air into combustion chamber 25, and to form secondary air jets 45 in a suitable pattern about discharge end 33 of venturi nozzle 32. In one preferred embodiment according to this invention, such secondary air inlet means comprise combustion chamber wall 20 having a plurality of secondary air ports 22 positioned about venturi nozzle 32. FIG. 6A shows one preferred embodiment of an arrangement of generally circular secondary air ports 22 with respect to an inlet, such as venturi nozzle 32, combustion chamber wall 20 or flame holder disk 52. FIG. 6B shows another preferred embodiment according to this invention, wherein each secondary air port 22 is formed as an arcuate slot. As used throughout this specification and in the claims, the phrase arcuate slot is intended to relate to the slot being curved or arcuate along centerline 21, as shown in FIG. 6B. As shown in FIG. 6B, four secondary air ports 22 peripherally surround the inlet. As shown in FIG. 6B, according to one preferred embodiment of this invention, a radius of the slot forming secondary air port 22 does not intersect with, or is at a distance from, the center of the inlet. Also as shown in FIG. 6B, four secondary air ports 22 are arranged in two pairs of two wherein the slots are positioned askew with respect to a curvature of a periphery of flame holder disk 52. It is apparent that more or less secondary air ports 22 can be positioned in various other patterns about the inlet, such as venturi nozzle 32, combustion chamber wall 20 or flame holder disk 52.

Secondary air ports 22 provide mixing energy and additional air required to complete combustion of the fuel and primary air mixture in such a manner as to reduce the $NO_x$ production, as compared to conventional in-shot burners, while maintaining acceptable CO emission performance.

Circular secondary air ports 22 provide a low surface area, yet high-energy secondary mixing mechanism. The high-energy secondary air jet 45 quickly entrains the fuel and primary air mixture, which results in short burn-out lengths with high excess air at near premixed conditions. This type of mixing maintains a lower overall flame temperature, which in turn decreases $NO_x$ production, since $NO_x$ production is related to flame temperature, lowering the flame temperature will lower $NO_x$ emissions, while still providing thorough mixing necessary to maintain acceptable CO emissions.

One side effect of using circular secondary air ports 22 can be a relatively high system pressure drop required to draw the necessary amount of air through the relatively small secondary air ports 22. Increasing the circular port diameter can decrease pressure drop, but may only provide a minimal increase in jet surface area, which may not be sufficient to offset a decrease in jet velocity. The reduction of the jet velocity can cause a reduction in mixing energy, consequently leading to reduced effectiveness of the mixing and high CO production.

Figure 9:
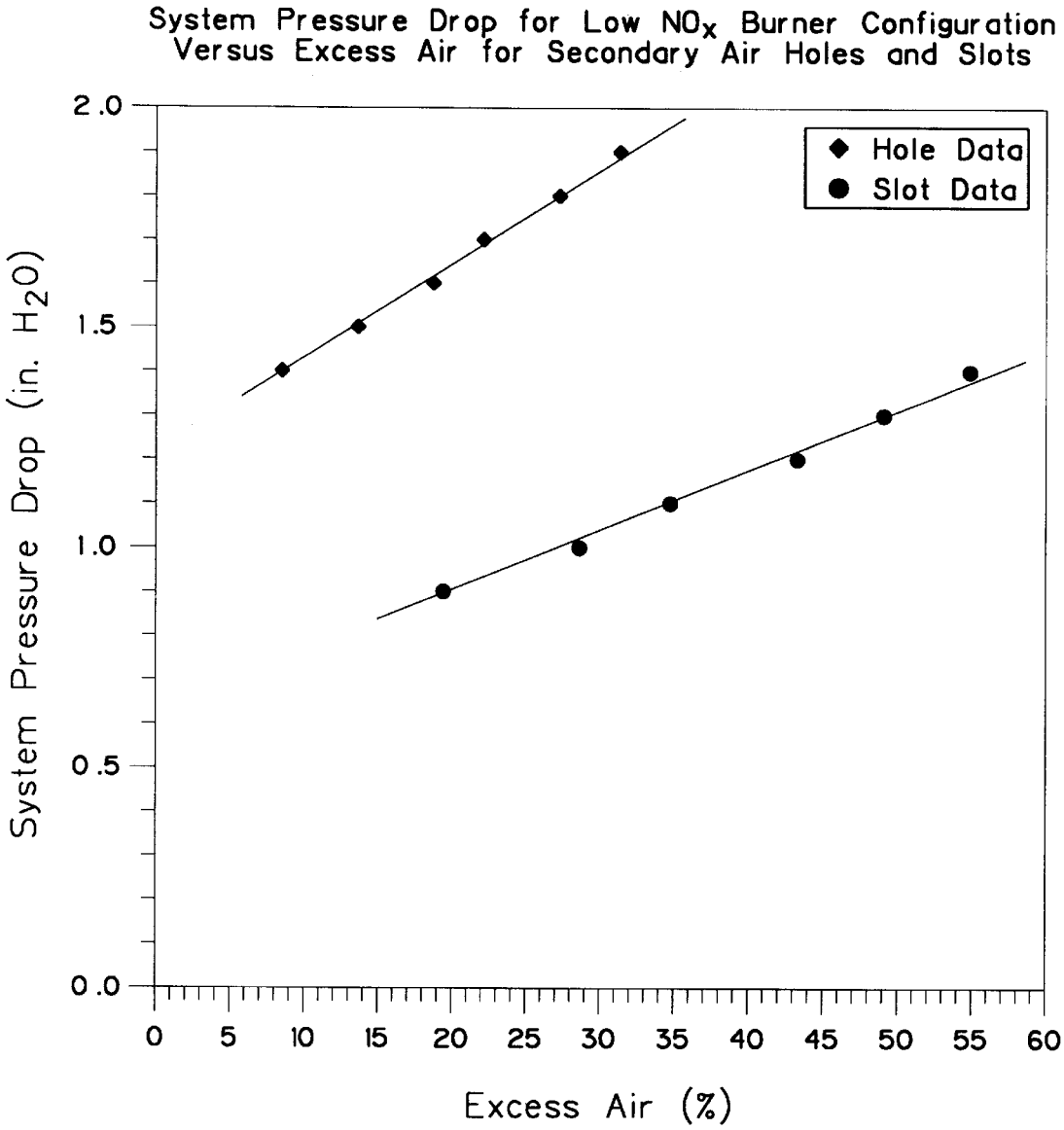
FIG. 9 is a graph showing experimental results, comparing a circular hole secondary air port apparatus against a slotted secondary air port, of a system pressure drop versus excess air for the secondary air ports.

The slot shaped secondary air port 22 provides a lower pressure drop as compared to the circular hole, yet provides enough mixing surface to offset the reduction in the velocity of secondary air jet 45. In essence, the slot shaped port produces a thin sheet or layer of air, which has a larger cross-sectional area than the circular ports and therefore a lower pressure drop and a lower velocity, as well as a significantly larger mixing surface area. When tested, both the CO and $NO_x$ emissions were slightly higher for the slot configuration than for the circular hole configuration, but the small sacrifice in emissions, as shown in FIG. 9, was more than compensated for by an approximately 40% reduction in overall system pressure drop.

In one preferred embodiment of this invention, each secondary air port 22 has swaged inlet 23, as shown in FIGS. 4A and 4B. As previously discussed, significantly improved flame stability is achieved by using such swaged inlet 23. Swaged inlet 23 significantly increases the velocity profile and momentum of secondary air flow within combustion chamber 25, thereby drawing or entraining the combustion flame to the outer periphery of each secondary air jet 45.

In one preferred embodiment according to this invention, control means can be used to vary the fuel and primary air flow so that the momentum of the fuel and primary air flow is approximately 30% to approximately 40% of the momentum of flow of each secondary air jet 45. Such control means may comprise a suitably sized and shaped venturi nozzle 32 and/or flame holder disk 52. It is also apparent that such control means may also comprise properly positioned sensors and/or programmed computing means for determining suitable fuel and primary air flow conditions.

Enhanced combustion performance, such as reduced $NO_x$ and CO emissions are accomplished according to the process and apparatus of this invention, primarily due to the relatively high-velocity and momentum of secondary air jets 45, a relatively high equivalence ratio of the fuel and primary air, and a strong internal recirculation or entrainment pattern which is established by secondary air jets 45. FIG. 8 illustrates recirculation zones 62 that are formed by secondary air jets 45. The relatively high velocity secondary air jets 45 cause rapid mixing of the preferably premixed fuel and primary air mixture into, or at a boundary of, secondary air jets 45 and thereby establish and cool combustion flame 56, preferably at the partial periphery of each secondary air jet 45. The velocity and position of the fuel and primary air jet, which is established by the design of flame holder disk 52 and venturi nozzle 32, is critical to provide a stable flame that does not flashback, particularly in view of the strong reverse flow within combustion chamber 25, as established by secondary air jets 45.

According to one preferred embodiment of the process of this invention, combustion flame 56 does not become established or initially combust upstream of the periphery of secondary air jet 45, since there is insufficient air in the fuel and primary air flow for ignition and combustion to occur within combustion chamber 25 and upstream of secondary air jet 45, particularly under given pressure, temperature and/or stoichiometric conditions. Also, with natural gas as the fuel, with an equivalence ratio of the fuel and primary air mixture in a range from approximately 1.7 to approximately 2.5, the fuel will not burn since such equivalence ratio is significantly higher than the upper flammability limit for natural gas, for example, which is approximately 1.7.

Secondary air jets 45 establish an internal combustion product recirculation pattern that improves or enhances performance of the process, since the combustion products reduce the oxygen concentration in secondary air jets 45 and also suppress combustion flame 56 temperature, thereby reducing $NO_x$ formation, CO formation, and burner noise.

Figure 7:
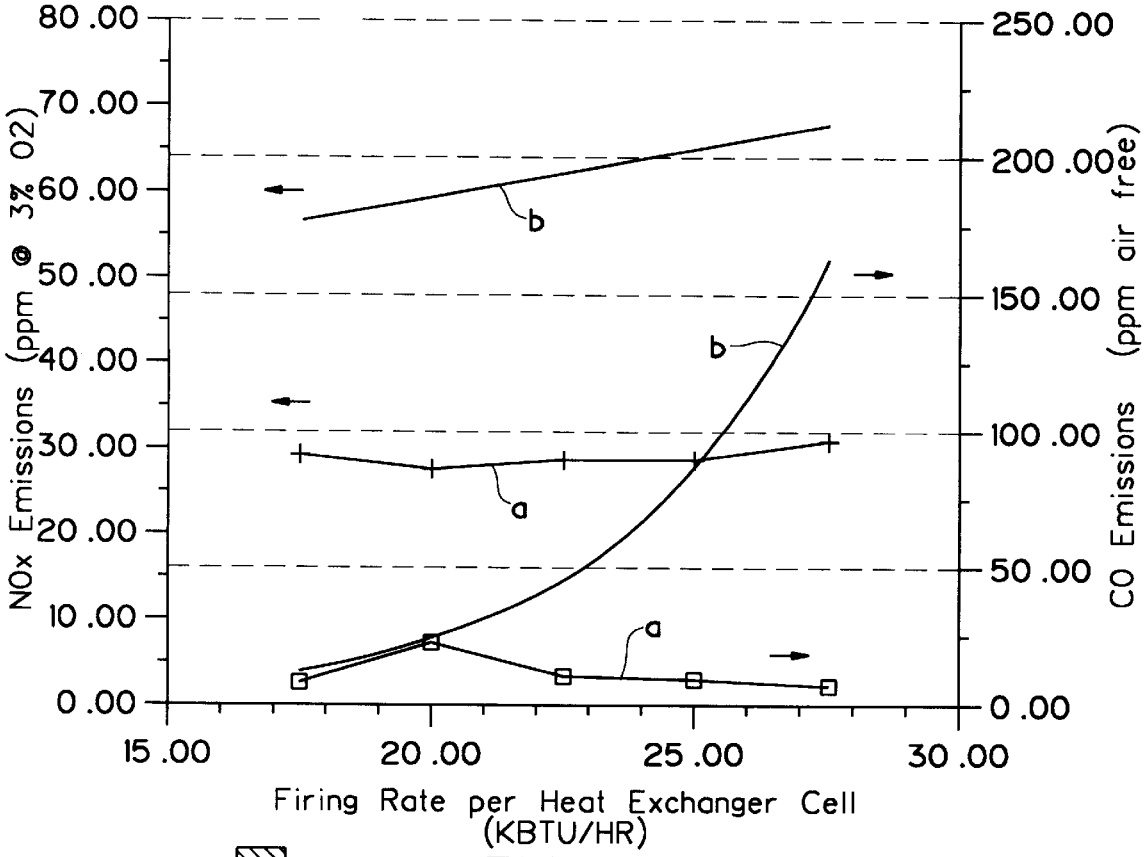
FIG. 7 is a graph showing experimental results showing a comparison, of nitrogen oxides emissions and carbon monoxide emissions as a function of a firing rate per heat exchanger cell, between a furnace according to the process and apparatus of this invention and a conventional furnace.

FIG. 7 shows experimental results identifying the performance of the process and apparatus tested according to this invention, compared to that of conventional burner technology. As can be seen from the graphical representation, $NO_x$ emissions are about one-half to about one-third of $NO_x$ emissions of conventional burners. According to the process and apparatus of this invention, as represented by the lines in FIG. 7 that are labeled with "A", CO emissions are significantly reduced relative to CO emissions levels from conventional burners operating at relatively high firing densities, as represented by the lines in FIG. 7 that are labelled with "B". This is a desirable characteristic because it allows higher heat input to each heat exchanger cell of the furnace.

Figure 10:
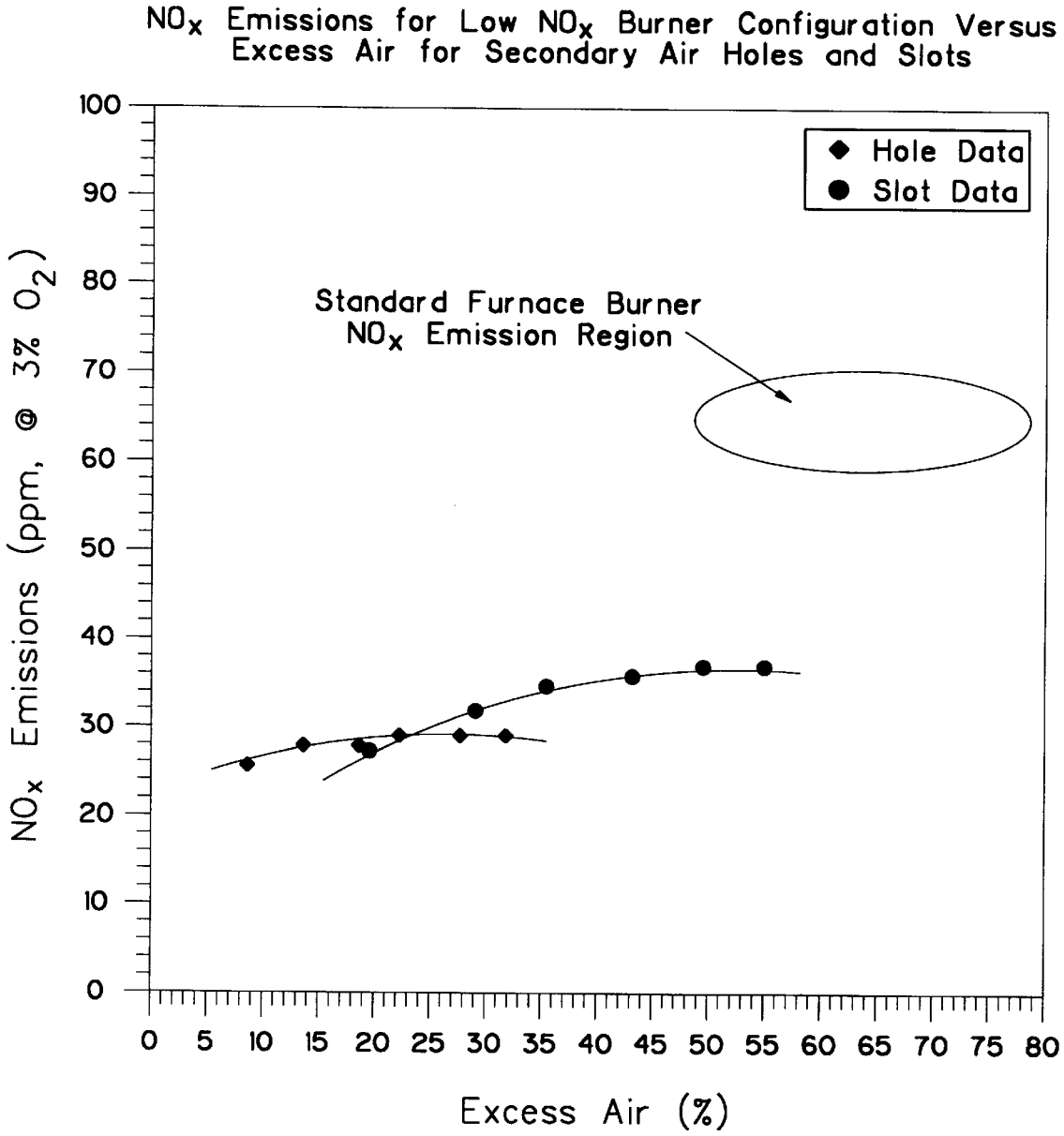
FIG. 10 is a graph showing experimental results, comparing a circular hole secondary air port apparatus against a slotted secondary air port, of $NO_x$ emissions versus excess air for the secondary air ports.
Figure 11:
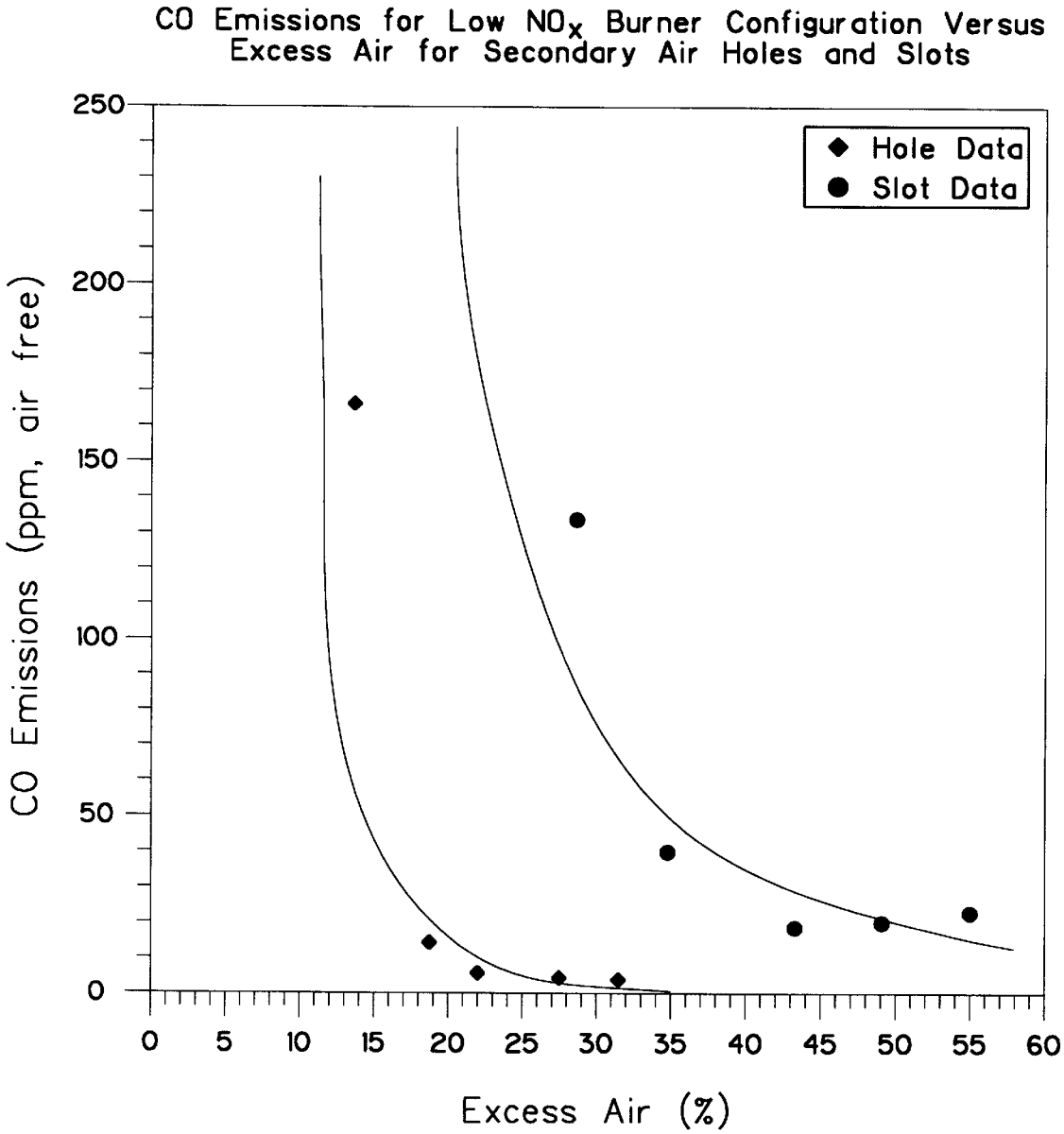
FIG. 11 is a graph showing experimental results, comparing a circular hole secondary air port apparatus against a slotted secondary air port, of CO emissions versus excess air for the secondary air ports.

FIGS. 9–11 show graphical representations of experimental data taken according to processes conducted using apparatuses according to this invention. The graphical representations illustrate differences between secondary air port 22 comprising a circular hole and secondary air port 22 comprising a slot, particularly an arcuate slot.

While in the foregoing specification this invention has been described in relation to certain preferred embodiments thereof, and many details have been set forth for purpose of illustration it will be apparent to those skilled in the art that the invention is susceptible to additional embodiments and that certain of the details described herein can be varied considerably without departing from the basic principles of the invention.

We claim:

1. An apparatus for combusting fuel, the apparatus comprising:

at least one combustion chamber wall forming a combustion chamber, primary means for forming a premixed fuel and primary oxidant mixture which is so fuel-enriched that the premixed fuel and primary oxidant mixture cannot burn under fuel and primary oxidant conditions within a first zone of the combustion chamber; and said at least one combustion chamber wall having a plurality of ports peripherally surrounding said inlet, and secondary means for introducing a second supply of oxidant into the combustion chamber through said port and forming a plurality of secondary oxidant jets that draw the premixed fuel and primary oxidant mixture through the first zone and into a second zone of the combustion chamber combust the premixed fuel and primary oxidant mixture in the second zone and form a stabilized combustion flame anchored about a periphery of the secondary oxidant jets.

2. An apparatus according to claim 1 wherein each said port is shaped arcuate along a centerline of said port.

3. An apparatus according to claim 2 wherein said inlet has a circular cross section with a center, each said port has a radius, and said radius is at a distance from said center.

4. An apparatus according to claim 2 wherein each said port is positioned askew with respect to a curvature of a periphery of said inlet.

5. An apparatus according to claim 1 wherein each said port has a swaged entry region.

6. An apparatus according to claim 1 wherein there are four said ports.

7. An apparatus according to claim 1 wherein each said port has an approximately uniform width.

8. An apparatus according to claim 1 wherein two opposing end portions of each said port are rounded.

* * * * *